US012728345B1

(12) United States Patent
Murphy

(10) Patent No.: US 12,728,345 B1
(45) Date of Patent: Sep. 8, 2026

(54) SUPPORT BOARD FOR USE WITH A PUZZLE OR A GAME

(71) Applicant: James B. Murphy, Toms River, NJ (US)

(72) Inventor: James B. Murphy, Toms River, NJ (US)

( * ) Notice: Subject to any disclaimer, the term of this patent is extended or adjusted under 35 U.S.C. 154(b) by 296 days.

(21) Appl. No.: 18/602,180

(22) Filed: Mar. 12, 2024

(51) Int. Cl.
*A63F 9/10* (2006.01)

(52) U.S. Cl.
CPC ..... *A63F 9/1044* (2013.01)

(58) Field of Classification Search
CPC ..... A63F 9/1044; A63F 2009/105
USPC ..... 273/309; 206/315.1
See application file for complete search history.

(56) References Cited

U.S. PATENT DOCUMENTS 68,302 A * 8/1867 Jennings ..... A63F 1/06 273/309
174,958 A * 3/1876 Homrighaus ..... A63F 3/0023 273/285
2,600,951 A * 6/1952 Edwards ..... A63F 1/06 D21/392
4,436,307 A * 3/1984 Caldwell ..... A63F 9/1044 273/157 R
4,486,018 A * 12/1984 Keller, Jr. ..... A63F 9/1044 220/377
4,552,361 A * 11/1985 LaFleur ..... A63F 9/1044 273/DIG. 30
4,811,954 A * 3/1989 Hemmann ..... A63F 3/0023 273/284
4,865,325 A 9/1989 Stolz
4,984,798 A * 1/1991 Silberstein ..... A63F 9/1044 40/781
5,054,783 A * 10/1991 Hull ..... A45C 9/00 190/11
5,120,069 A * 6/1992 Shaw ..... A63F 3/061 273/237
5,213,326 A * 5/1993 Rundell ..... A63F 3/06 273/269
5,219,168 A 6/1993 Morris
5,250,000 A * 10/1993 Boutin ..... A63F 3/0023 273/284
5,273,289 A * 12/1993 Morse ..... A63F 9/1044 273/287
5,429,372 A * 7/1995 Spaziani ..... A63F 9/1044 273/309

(Continued)

FOREIGN PATENT DOCUMENTS

WO 1993916775 9/1993

*Primary Examiner* — Jacob K Ackun
(74) *Attorney, Agent, or Firm* — Kyle A. Fletcher, Esq.

(57) ABSTRACT

The support board for use with a puzzle or a game is an accessory used with a jigsaw puzzle. The support board for use with a puzzle or a game: a) forms a raised horizontal surface for the assembly of the jigsaw puzzle; and b) forms a structure that separates the assembled and unassembled portions of the jigsaw puzzle. The support board for use with a puzzle or a game stores the jigsaw puzzle when not in use. The support board for use with a puzzle or a game incorporates an assembly structure and a plurality of piece pans. The assembly structure rotates between a closed position and an open position. The assembly structure forms the raised horizontal surface in the open position. The assembly structure contains the plurality of piece pans and the jigsaw puzzle in the closed position.

9 Claims, 7 Drawing Sheets

(56) References Cited

U.S. PATENT DOCUMENTS

| | | | | |
|---|---|---|---|---|
| D400,600 | S | 11/1998 | Ackerman | |
| 6,431,543 | B1 * | 8/2002 | Cole | A63F 9/12 273/153 R |
| 6,752,678 | B1 * | 6/2004 | Chuang | A63F 9/12 273/157 R |
| 2005/0236777 | A1 * | 10/2005 | Danelius | A63F 3/00895 273/309 |
| 2007/0266911 | A1 | 11/2007 | Lee | |
| 2021/0170267 | A1 | 6/2021 | Malki | |
| 2023/0356069 | A1 * | 11/2023 | Che | A63F 9/1044 |
| 2025/0108286 | A1 * | 4/2025 | Zhang | F16M 11/10 |

* cited by examiner

SUPPORT BOARD FOR USE WITH A PUZZLE OR A GAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of display boards. (A63F9/1044)

Summary of Invention

The support board for use with a puzzle or a game is an accessory that is configured for use with a jigsaw puzzle. The support board for use with a puzzle or a game: a) forms a raised horizontal surface for the assembly of the jigsaw puzzle; and b) forms a structure that allows for the separation of assembled and unassembled portions of the jigsaw puzzle. The support board for use with a puzzle or a game stores the jigsaw puzzle when not in use. The support board for use with a puzzle or a game is a collapsible structure. The support board for use with a puzzle or a game comprises an assembly structure and a plurality of piece pans. The assembly structure rotates between a closed position and an open position. The assembly structure forms the raised horizontal surface in the open position. The assembly structure contains the plurality of piece pans and the jigsaw puzzle in the closed position.

These together with additional objects, features and advantages of the support board for use with a puzzle or a game will be readily apparent to those of ordinary skill in the art upon reading the following detailed description of the presently preferred, but nonetheless illustrative, embodiments when taken in conjunction with the accompanying drawings.

In this respect, before explaining the current embodiments of the support board for use with a puzzle or a game in detail, it is to be understood that the support board for use with a puzzle or a game is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the support board for use with a puzzle or a game.

It is therefore important that the claims be regarded as including such equivalent construction insofar as they do not depart from the spirit and scope of the support board for use with a puzzle or a game. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
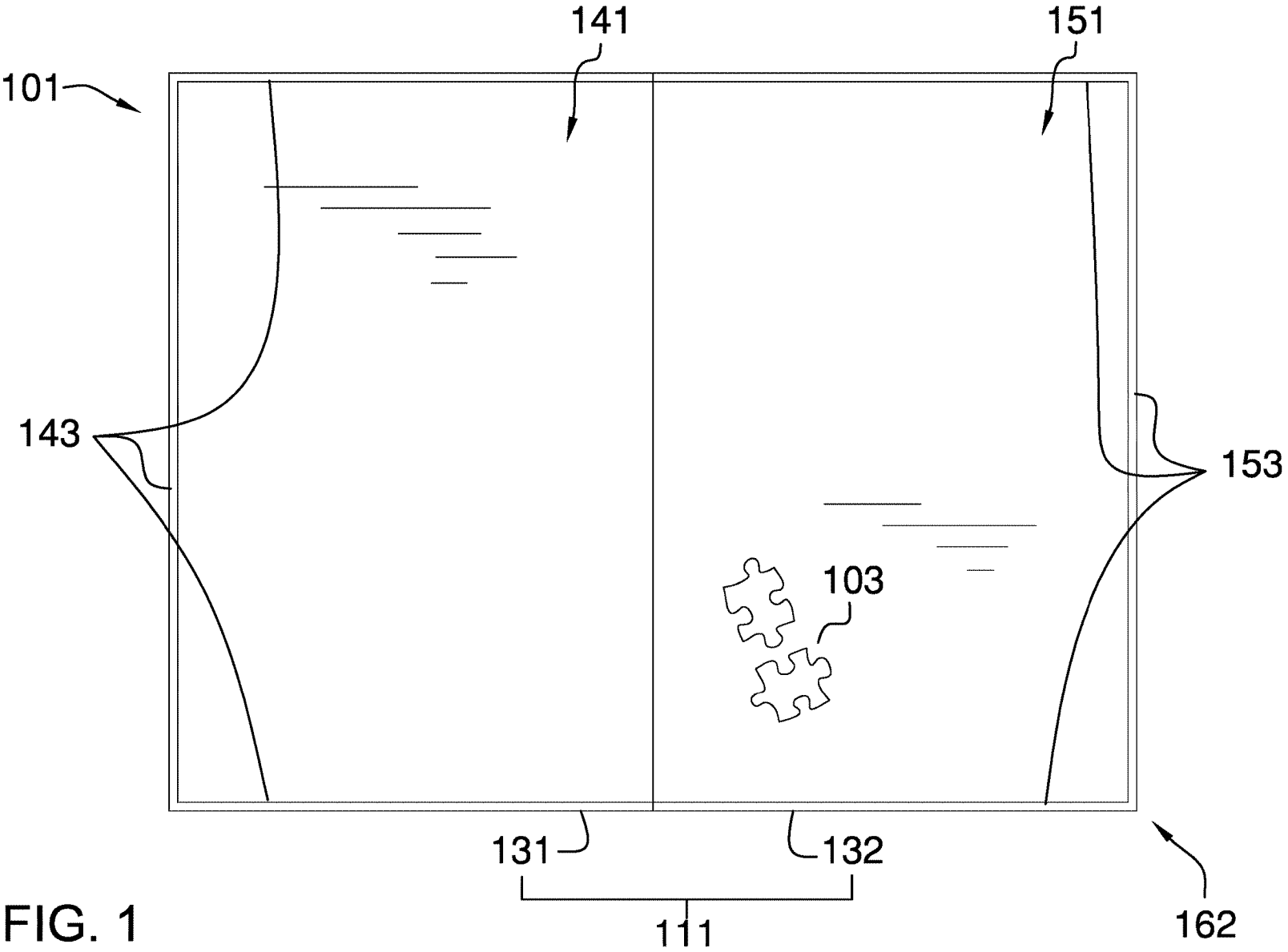
FIG. 1 is an anterior view of an embodiment of the disclosure.
Figure 2:
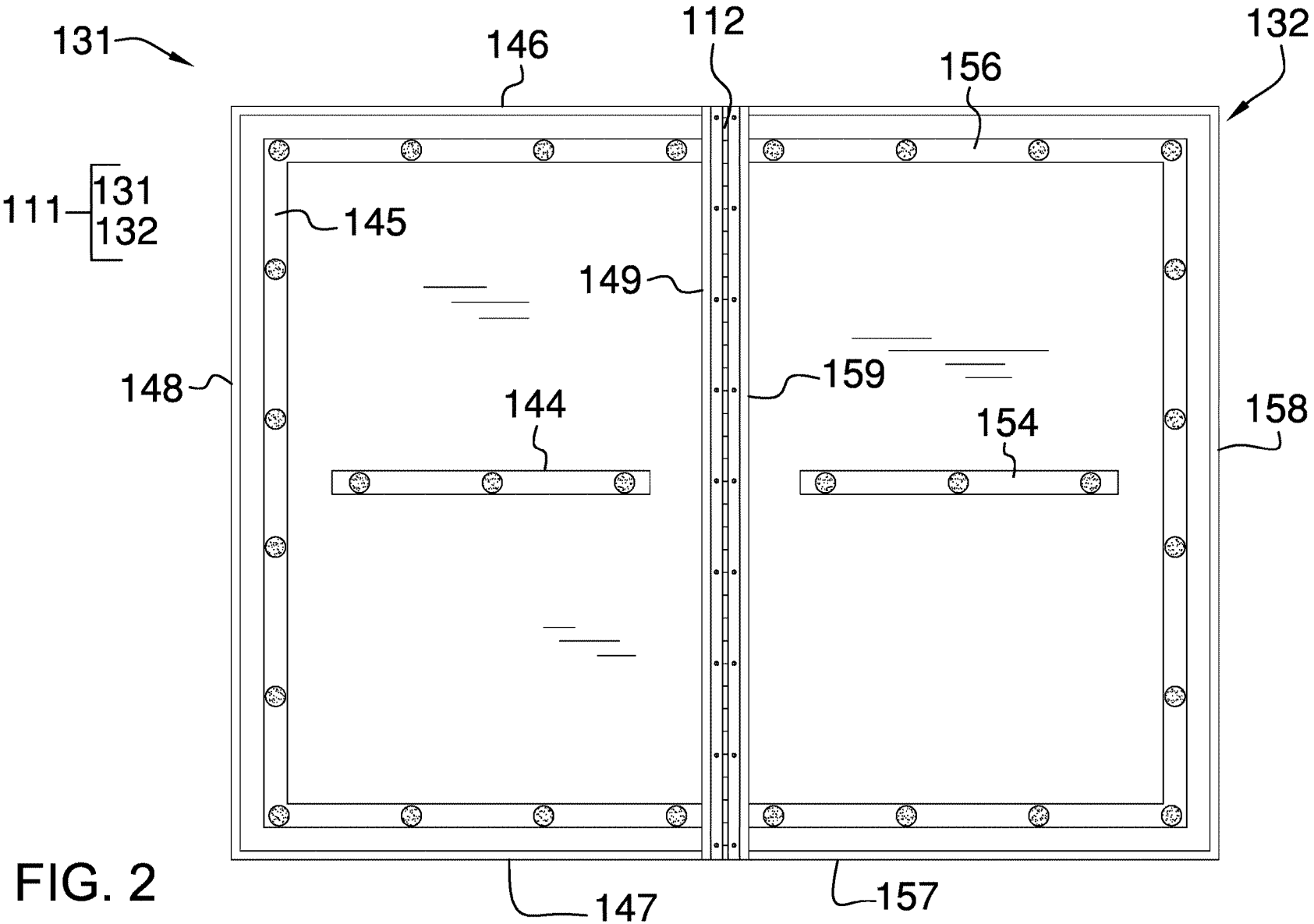
FIG. 2 is a posterior view of an embodiment of the disclosure.
Figure 4:
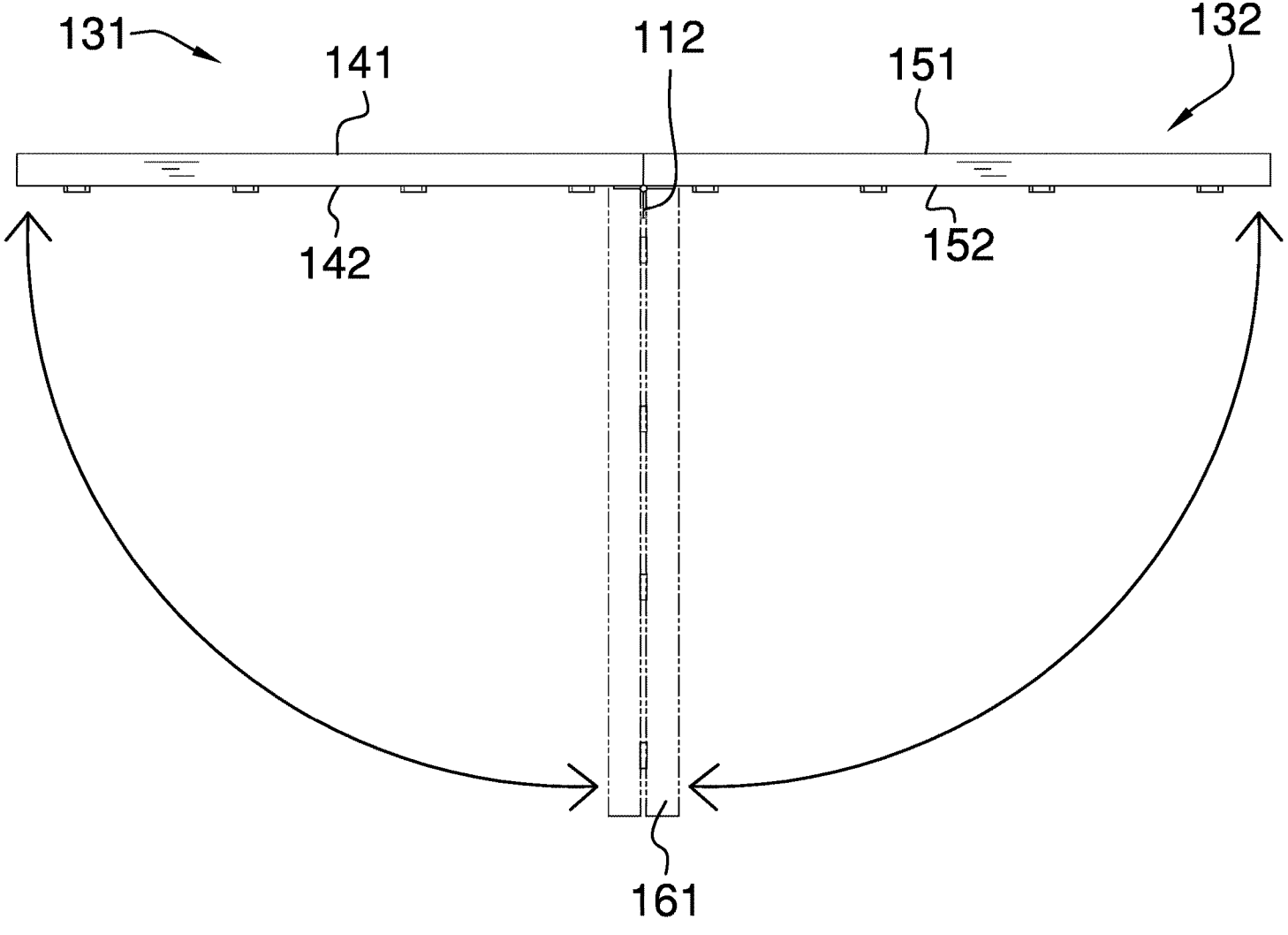
FIG. 4 is a top view of an embodiment of the disclosure.
Figure 3:
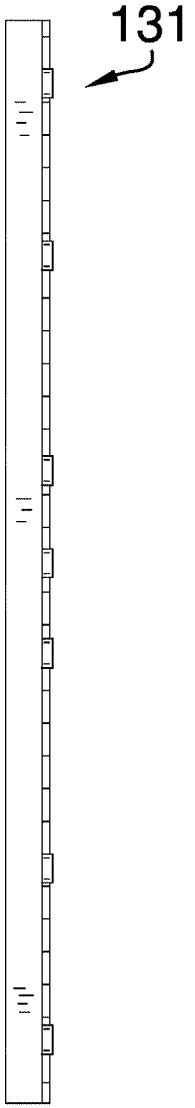
FIG. 3 is a side view of an embodiment of the disclosure.
Figure 5:
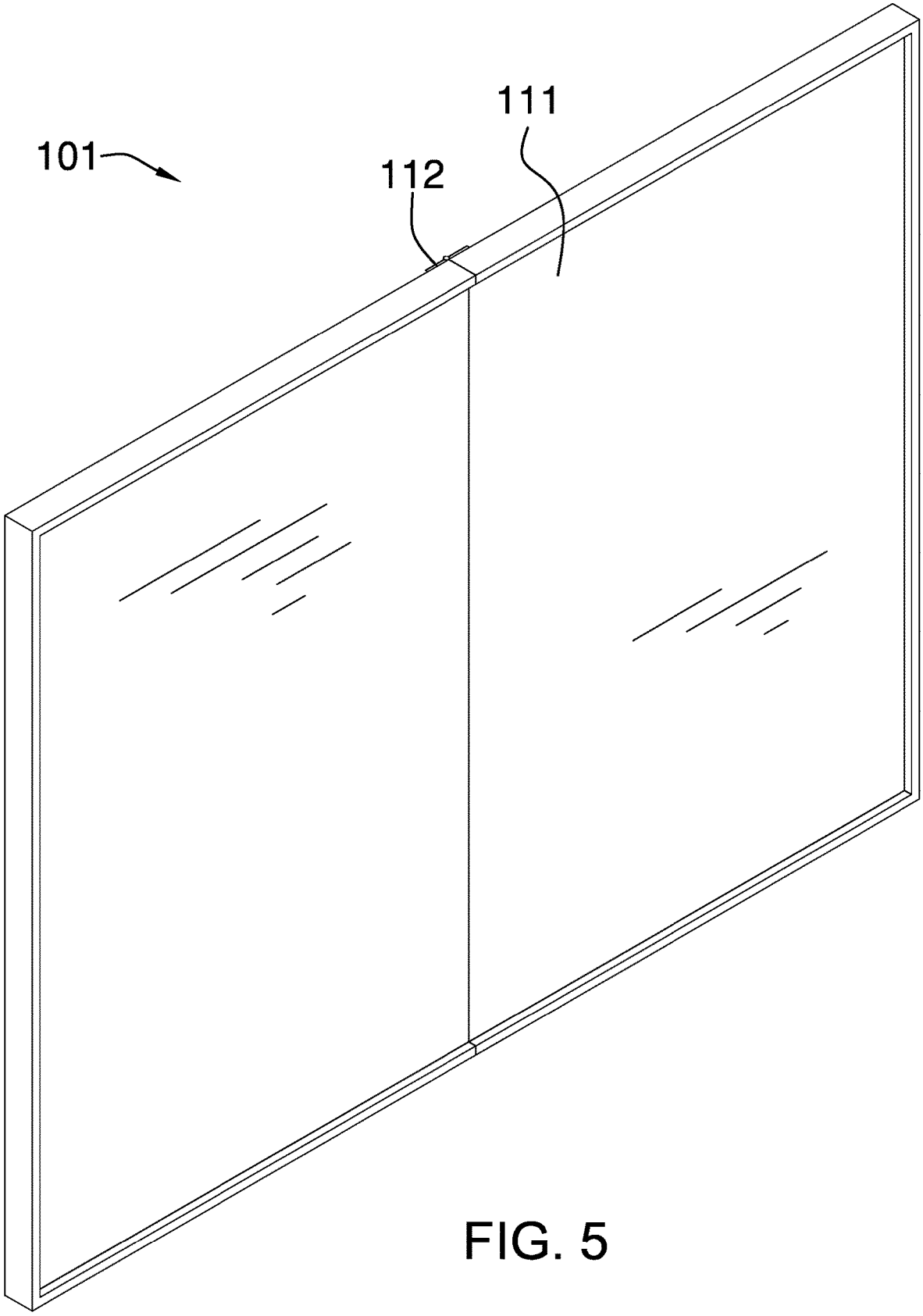
FIG. 5 is an anterior perspective view of an embodiment of the disclosure.
Figure 6:
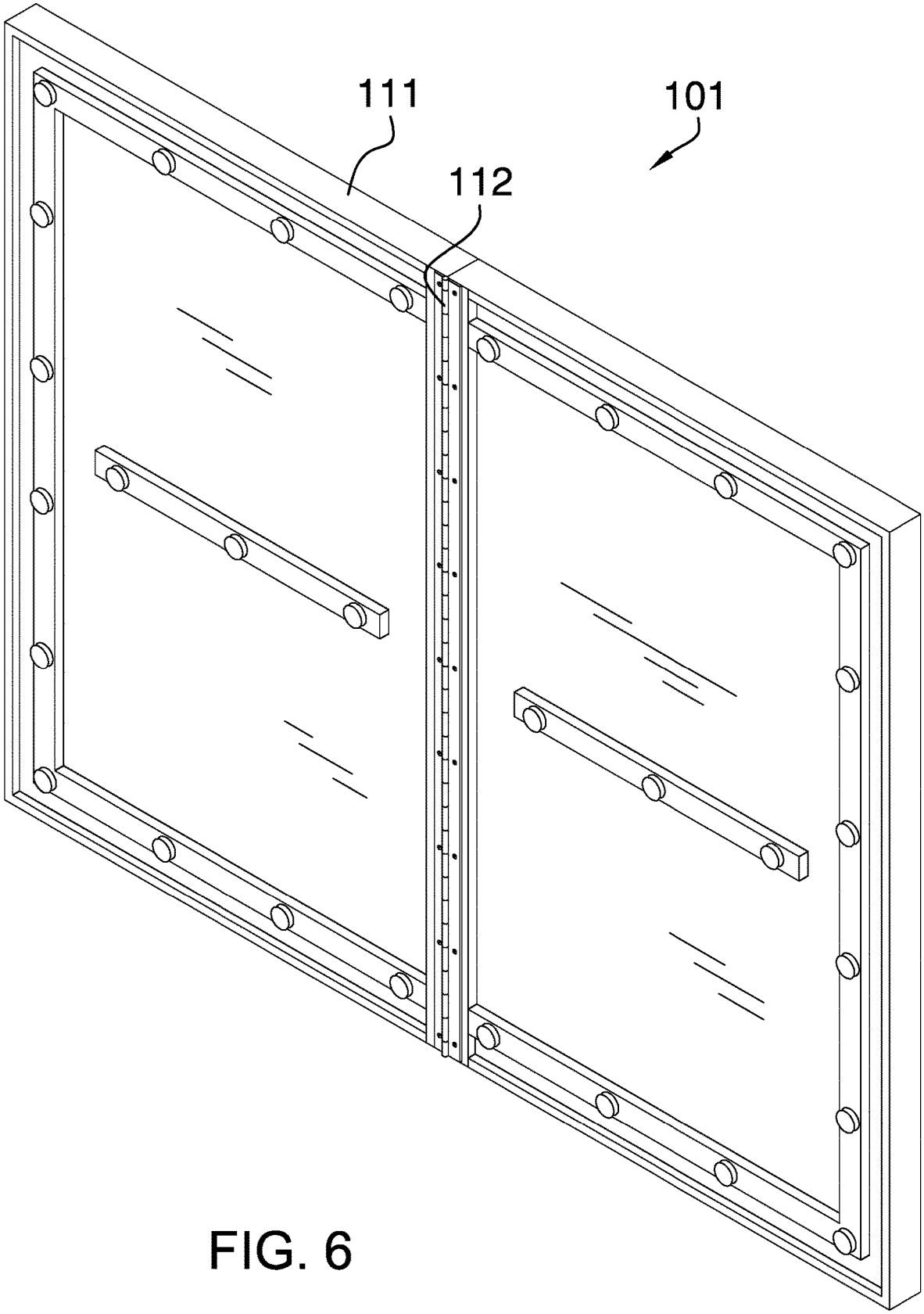
FIG. 6 is a posterior perspective view of an embodiment of the disclosure.
Figure 8:
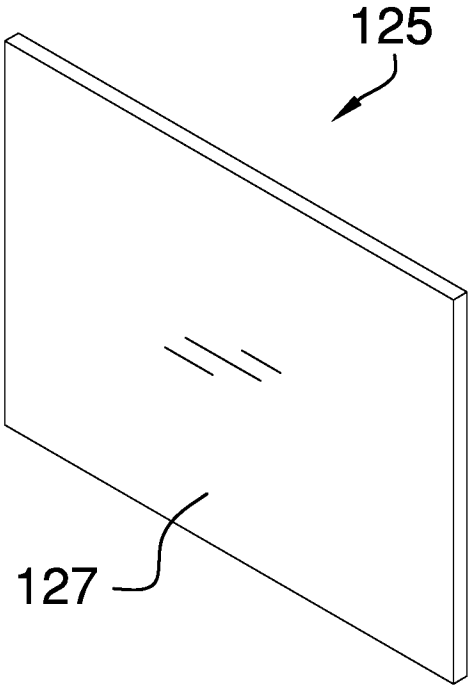
FIG. 8 is a detail view of an embodiment of the disclosure.
Figure 7:
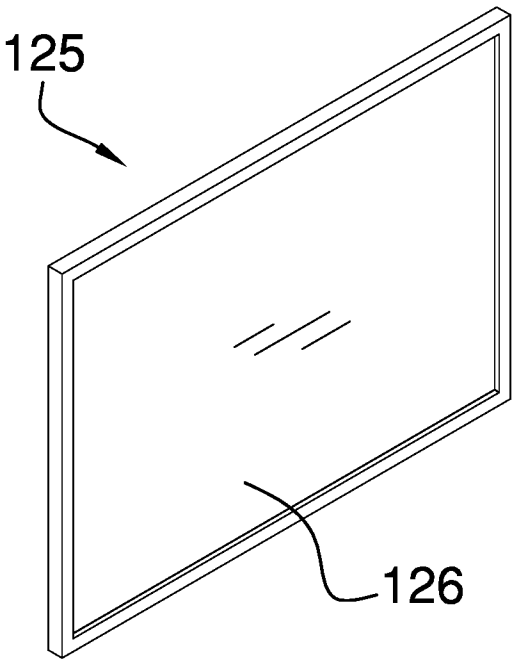
FIG. 7 is a detail view of an embodiment of the disclosure.
Figure 9:
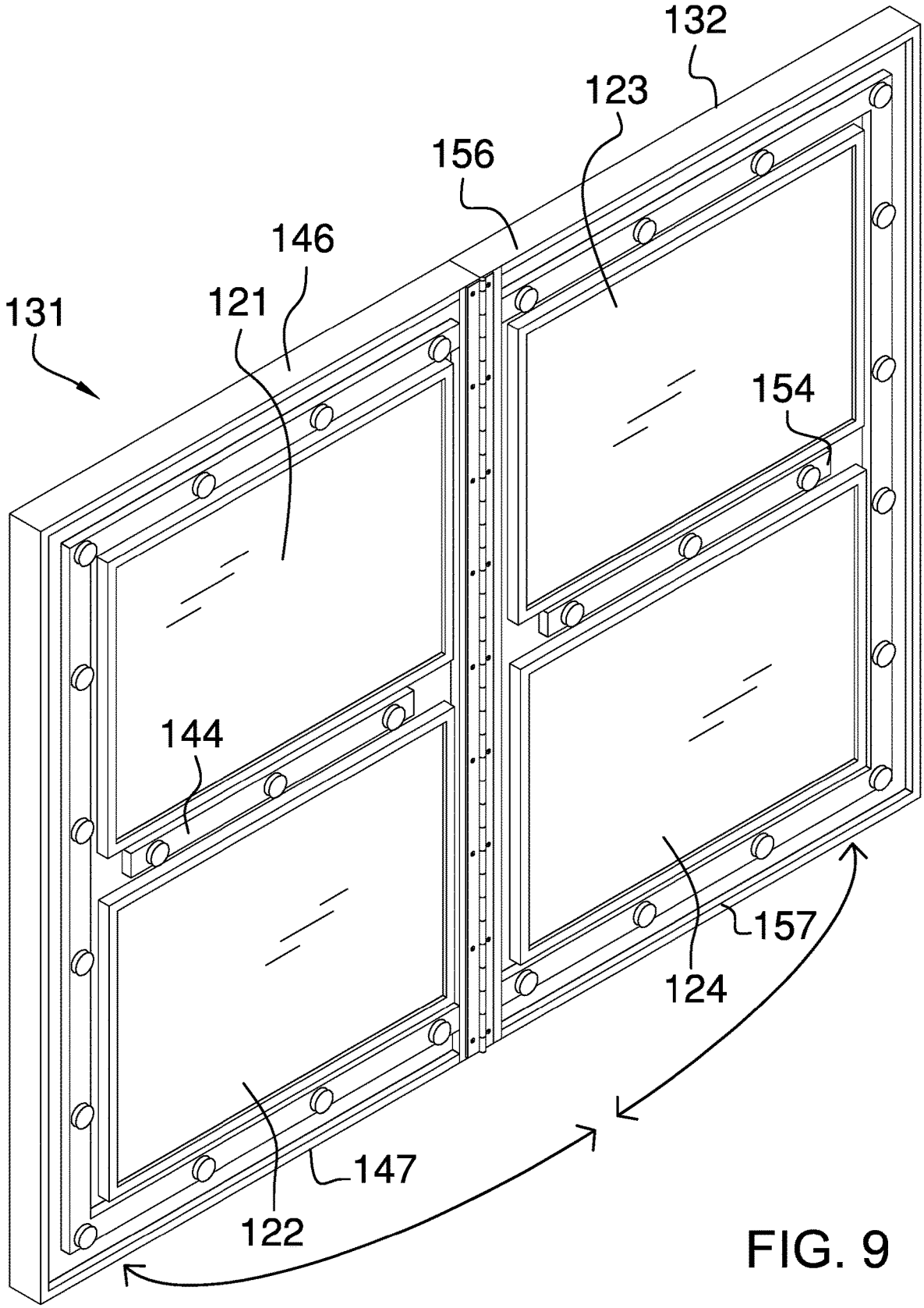
FIG. 9 is an assembled posterior perspective view of an embodiment of the disclosure.

Detailed reference will now be made to one or more potential embodiments of the disclosure, which are illustrated in FIGS. 1 through 9.

The support board for use with a puzzle or a game 100 (hereinafter invention) is an accessory that is configured for use with a jigsaw puzzle 103. The jigsaw puzzle 103 is defined elsewhere in this disclosure. The invention 100: a) forms a raised horizontal surface for the assembly of the jigsaw puzzle 103; and b) forms a structure that allows for the separation of assembled and unassembled portions of the jigsaw puzzle 103. The invention 100 stores the jigsaw puzzle 103 when not in use. The invention 100 is a collapsible structure. The invention 100 comprises an assembly structure 101 and a plurality of piece pans 102. The assembly structure 101 rotates between a closed position 161 and an open position 162. The assembly structure 101 forms the raised horizontal surface in the open position 162. The assembly structure 101 contains the plurality of piece pans 102 and the jigsaw puzzle 103 in the closed position 161. The assembly structure 101 is a prism shaped structure.

The assembly structure 101 has a disk shape. The assembly structure 101 is formed as a lateral disk structure. The assembly structure 101 is a rotating structure. The assembly structure 101 rotates between a closed position 161 and an open position 162. The assembly structure 101 forms a divided pan structure in the open position 162. By divided pan structure is meant that the assembly structure 101: a) has a pan shape when rotated into the open position 162; and, b) the hollow interior of the pan shape is divided into segregated spaces. The assembly structure 101 forms the raised horizontal surface in the open position 162. The assembly structure 101 forms a protected space when the assembly structure 101 rotates into the closed position 161. The assembly structure 101 contains the plurality of piece pans 102 and the jigsaw puzzle 103 in the protected space formed by the assembly structure 101 in the closed position 161.

The assembly structure 101 comprises a plurality of assembly pans 111 and a piano hinge 112.

Each assembly pan selected from the plurality of assembly pans 111 is a prism shaped structure. Each selected assembly pan has a disk shape. Each selected assembly pan forms a divided pan structure.

The piano hinge 112 is a hinge structure. The piano hinge 112 is a rotating structure. The piano hinge 112 attaches the first assembly pan 131 to the second assembly pan 132 such that the second assembly pan 132 rotates relative to the first assembly pan 131. The piano hinge 112 allows the assembly structure 101 to rotate between the closed position 161 and the open position 162. The piano hinge 112 rotates into the closed position 161 such that the first open face 142 aligns with the second open face 152 of the first assembly pan 131 and the second assembly pan 132 respectively.

The plurality of assembly pans 111 comprises a first assembly pan 131 and a second assembly pan 132.

The first assembly pan 131 is a prism shaped structure. The first assembly pan 131 has a disk shape. The first assembly pan 131 has a rectangular block structure. The first assembly pan 131 has a pan shape. The first assembly pan 131 comprises a first closed face 141, a first open face 142, a first plurality of lateral faces 143, a first divider plate 144, and a first perimeter cushion structure 145.

The first closed face 141 is the closed face of the pan shape of the first assembly pan 131. The first closed face 141 forms the containment surface of the first assembly pan 131 with the greatest surface area. The first open face 142 is the open face of the pan shape of the first assembly pan 131. The first open face 142 is the face of the first assembly pan 131 that is distal from the first closed face 141.

The first plurality of lateral faces 143 form the lateral face structure of the pan shape of the first assembly pan 131. The first plurality of lateral faces 143 form the balance of the containment surfaces of the first assembly pan 131. The first plurality of lateral faces 143 comprises a first superior lateral face 146, a first inferior lateral face 147, a first exterior lateral face 148, and a first interior lateral face 149.

The first superior lateral face 146 is the lateral face of the first assembly pan 131 with the greatest span of length. The first superior lateral face 146 forms an exterior face of the lateral disk structure of the assembly structure 101 when the assembly structure 101 is in the open position 162. The first inferior lateral face 147 is the lateral face of the first assembly pan 131 that is distal from the first superior lateral face 146. The first inferior lateral face 147 forms an exterior face of the lateral disk structure of the assembly structure 101 when the assembly structure 101 is in the open position 162. The first exterior lateral face 148 is the remaining lateral face of the first assembly pan 131 that forms an exterior face of the lateral disk structure of the assembly structure 101 when the assembly structure 101 is in the open position 162. The first interior lateral face 149 is the lateral face of the first assembly pan 131 that is distal from the first exterior lateral face 148.

The first divider plate 144 is a prism shaped structure. The first divider plate 144 mounts on the interior surface of the first closed face 141 such that the center axis of the first divider plate 144 is parallel to the first superior lateral face 146 and the first inferior lateral face 147. The first divider plate 144 is located on the first closed face 141 such that the center axis of the first divider plate 144 is halfway between the first superior lateral face 146 and the first inferior lateral face 147. The first divider plate 144 forms the physical structure that divided the hollow interior of the first assembly pan 131 into two segregated spaces.

The first perimeter cushion structure 145 forms a cushion structure that protects a portion of the perimeter surface of the first open face 142. The first perimeter cushion structure 145 is a felt padding that protects the inferior lip, the perimeter surface, and the exterior lip structures of the following lateral face structures: a) the first superior lateral face 146; b) the first inferior lateral face 147; and, c) the first exterior lateral face 148.

The second assembly pan 132 is a prism shaped structure. The second assembly pan 132 has a disk shape. The second assembly pan 132 has a rectangular block structure. The second assembly pan 132 has a pan shape.

The form factor of the second assembly pan 132 is identical to the form factor of the first assembly pan 131. The piano hinge 112 attaches to the second assembly pan 132 to the first assembly pan 131 such that the second assembly pan 132 rotates relative to the first assembly pan 131. The second assembly pan 132 rotates relative to the first assembly pan 131 such that the assembly structure 101 rotates between the closed position 161 and the open position 162. The first assembly pan 131 and the second assembly pan 132 form the lateral disk structure of the assembly structure 101 when the assembly structure 101 rotates into the open position 162. The first assembly pan 131 and the second assembly pan 132 form the protected space formed by the assembly structure 101 when the assembly structure 101 rotates into the closed position 161.

The second assembly pan 132 comprises a second closed face 151, a second open face 152, a second plurality of lateral faces 153, a second divider plate 154, and a second perimeter cushion structure 155.

The second closed face 151 is the closed face of the pan shape of the second assembly pan 132. The second closed face 151 forms the containment surface of the second assembly pan 132 with the greatest surface area. The second open face 152 is the open face of the pan shape of the second assembly pan 132. The second open face 152 is the face of the second assembly pan 132 that is distal from the second closed face 151.

The second plurality of lateral faces 153 form the lateral face structure of the pan shape of the second assembly pan 132. The second plurality of lateral faces 153 form the balance of the containment surfaces of the second assembly pan 132. The second plurality of lateral faces 153 comprises a second superior lateral face 156, a second inferior lateral face 157, a second exterior lateral face 158, and a second interior lateral face 159.

The second superior lateral face 156 is the lateral face of the second assembly pan 132 with the greatest span of length. The second superior lateral face 156 forms an exterior face of the lateral disk structure of the assembly structure 101 when the assembly structure 101 is in the open position 162. The second inferior lateral face 157 is the lateral face of the second assembly pan 132 that is distal from the second superior lateral face 156. The second inferior lateral face 157 forms an exterior face of the lateral disk structure of the assembly structure 101 when the assembly structure 101 is in the open position 162. The second exterior lateral face 158 is the remaining lateral face of the second assembly pan 132 that forms an exterior face of the lateral disk structure of the assembly structure 101 when the assembly structure 101 is in the open position 162. The second interior lateral face 159 is the lateral face of the second assembly pan 132 that is distal from the second exterior lateral face 158.

The second divider plate 154 is a prism shaped structure. The second divider plate 154 mounts on the interior surface of the second closed face 151 such that the center axis of the second divider plate 154 is parallel to the second superior lateral face 156 and the second inferior lateral face 157. The second divider plate 154 is located on the second closed face 151 such that the center axis of the second divider plate 154 is halfway between the second superior lateral face 156 and the second inferior lateral face 157. The second divider plate 154 forms the physical structure that divided the hollow interior of the second assembly pan 132 into two segregated spaces.

The second perimeter cushion structure 155 forms a cushion structure that protects a portion of the perimeter surface of the second open face 152. The second perimeter cushion structure 155 is a felt padding that protects the inferior lip, the perimeter surface, and the exterior lip structures of the following lateral face structures: a) the second superior lateral face 156; b) the second inferior lateral face 157; and, c) the second exterior lateral face 158.

The first open face 142 and the second open face 152 are aligned when the assembly structure 101 rotates into the closed position 161. The first open face 142 and the second open face 152 are the faces of the lateral disk structure of the assembly structure 101 that rest on a supporting surface when the assembly structure 101 forms the raised horizontal surface in the open position 162. The piano hinge 112 attaches the exterior lip of the first assembly pan 131 to the second assembly pan 132 by attaching the exterior lip of the first interior lateral face 149 to the exterior lip of the second interior lateral face 159.

The plurality of piece pans 102 comprises a collection of individual piece pans 125. Each individual piece pan 125 selected from the plurality of piece pans 102 is identical.

Each individual piece pan 125 selected from the plurality of piece pans 102 is a prism shaped structure. Each selected individual piece pan 125 has a disk shape. Each selected individual piece pan 125 has a pan shape. Each selected individual piece pan 125 stores a subset of puzzle pieces selected from the plurality of puzzle pieces of the jigsaw puzzle 103. Each selected individual piece pan 125 maintains the subset of puzzle pieces in an accessible manner when the assembly structure 101 is in the open position 162. Each selected individual piece pan 125 forms a protected space that contains the subset of puzzle pieces in an accessible manner when the assembly structure 101 is in the closed position 161. The form factor of any initial individual piece pan 125 selected from the plurality of piece pans 102 is identical to any subsequent individual piece pan 125 selected from the plurality of piece pans 102.

Each selected individual piece pan 125 further comprises an individual pp open face 126 and an individual pp closed face 127. The individual pp open face 126 is the open face of the pan shape of the individual piece pan 125. The individual pp open face 126 is the face of the individual piece pan 125 that is placed flush against the interior surface of a face selected from the group consisting of: a) the first closed face 141 of the first assembly pan 131; and, b) the second closed face 151 of the second open face 152. The individual pp closed face 127 is the closed face of the pan shape of the individual piece pan 125. The individual pp closed face 127 is the face of the individual piece pan 125 that is distal from the individual pp open face 126.

The plurality of piece pans 102 comprises a first piece pan 121, a second piece pan 122, a third piece pan 123, and a fourth piece pan 124.

The first piece pan 121 is a piece pan selected from the plurality of piece pans 102. The first piece pan 121 is the piece pan that is stored in the first assembly pan 131 between the first divider plate 144 and the first superior lateral face 146. The first piece pan 121 mounts in the first assembly pan 131 such that the individual pp open face 126 of the first piece pan 121 fits flush against the interior surface of the first closed face 141 of the first assembly pan 131 to form a protected space.

The second piece pan 122 is a piece pan selected from the plurality of piece pans 102. The second piece pan 122 is the piece pan that is stored in the first assembly pan 131 between the first divider plate 144 and the first inferior lateral face 147. The second piece pan 122 mounts in the first assembly pan 131 such that the individual pp open face 126 of the second piece pan 122 fits flush against the interior surface of the first closed face 141 of the first assembly pan 131 to form a protected space.

The third piece pan 123 is a piece pan selected from the plurality of piece pans 102. The third piece pan 123 is the piece pan that is stored in the second assembly pan 132 between the second divider plate 154 and the second superior lateral face 156. The third piece pan 123 mounts in the second assembly pan 132 such that the individual pp open face 126 of the third piece pan 123 fits flush against the interior surface of the second closed face 151 of the second assembly pan 132 to form a protected space.

The fourth piece pan 124 is a piece pan selected from the plurality of piece pans 102. The fourth piece pan 124 is the piece pan that is stored in the second assembly pan 132 between the second divider plate 154 and the second inferior lateral face 157. The fourth piece pan 124 mounts in the second assembly pan 132 such that the individual pp open face 126 of the fourth piece pan 124 fits flush against the interior surface of the second closed face 151 of the second assembly pan 132 to form a protected space.

The following definitions were used in this disclosure:

Accessory: As used in this disclosure, an accessory is a first object or first device that is configured for use with a second object or second device. The use of the accessory enhances the appearance or functionality of the second object or second device.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Barrier: As used in this disclosure, a barrier is a physical obstacle that forms a boundary between a first space and a second space. The barrier prevents the passage of an object between the first space and the second space.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Closed Position: As used in this disclosure, a closed position refers to a movable structure that is in an orientation that minimizes the perimetrical boundary presented by the movable structure. The closed position is often referred to as an object being "closed."

Collapsible: As used in this disclosure, the terms collapsible refers to an object that is configured such that the volume of the object is adjustable. By volume is meant the volume of the perimetrical boundary that contains the object. The verbs collapse and retract mean that the volume of the perimetrical boundary of the object changes from a larger volume to a smaller volume. The verbs expand and deploy mean that the volume of the perimetrical boundary of the object changes from a smaller volume to a larger volume.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a structure formed from a pad that is used to prevent injury or damage to a person or object.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Entertain: As used in this disclosure, to entertain means to attract and hold the attention of one or more individuals. The term entertainment refers to the method use to attract and maintain the attention of the one or more individuals.

Environment: As used in this disclosure, an environment refers to the physical conditions surrounding an object. The term environment is often limited to the physical conditions that the object interacts with.

Exterior: As used in this disclosure, the exterior is used as a relational term that implies that an object is not contained within the boundary of a structure or a space.

Fastening Device: As used in this disclosure, a fastening device is a device that is used to join or affix a first object to a second object.

Felt: As used in this disclosure, felt is a non-woven sheeting material formed as a mat of textile fibers. Use Mat, fiber, textile and sheeting Fold: As used in this disclosure, to fold means to bend an object back upon itself.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Image: As used in this disclosure, an image is an optical representation or reproduction of an indicia or of the appearance of something or someone. See indicia sentiment optical character recognition.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Jigsaw Puzzle: As used in this disclosure, a jigsaw puzzle is a puzzle. The jigsaw puzzle is a display that presents an image. The display of the image is subdivided into a plurality of puzzle pieces. Each piece selected from the plurality of puzzles is formed with one or more tabs and slots. The goal of the jigsaw puzzle is to interconnect the plurality of puzzle pieces with the goal of reassembling the image that is presented by the jigsaw puzzle. Use tabs and slots Lateral: As used in this disclosure, the term lateral refers to the movement of an object that is perpendicular to the primary sense of direction of an object and parallel to the horizontal plane (or perpendicular to the vertical plane). Lateral movement is always perpendicular to the anterior posterior axis. Lateral movement is often called sideways movement.

Lateral Disk Structure: As used in this disclosure, a lateral plate structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Left and Right: As used in this disclosure, the terms left and right are directional references associated with an object. The object is further defined with an anterior surface and a posterior surface. The terms left and right are standardized naming conventions for the lateral directions of the object. The terms left and right use the human body for the initial definition of the orientation. Specifically, when a human body is viewed from posterior side towards the anterior side, the left side of the human body is the lateral side of the human body that contains the heart. The right side of the human body is the lateral side of the body that contains the bulk of the liver. The left and right sides of the human body remain unchanged by changes to the direction from which the human body is viewed. The left side of any object is the same side as the left side of the human body when the object is viewed from posterior side towards the anterior side. The right side of any object is the same side as the right side of the human body when the object is viewed from posterior side towards the anterior side. The left and right sides of the object remain unchanged by changes to the direction from which the object is viewed.

Lip: As used in this disclosure, a lip refers to the region of the lateral face of a pan or tube structure that abuts the perimeter of the open face of the pan or tube structure. By abutting the perimeter of the open face is meant that the lip forms a brink with the surface that forms the perimeter of the open face. The lip of the interior surface of the pan structure is called the interior lip. The lip of the exterior surface of the pan structure is called the exterior lip. The region of the lateral face of a pan structure that abuts the perimeter of the closed face of the pan structure is called the brink lip.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction. In a one to one correspondence, the first element of the first set is said to be associated to the second element of the second set to which the first element corresponds.

Open Position: As used in this disclosure, an open position refers to a movable structure that is in an orientation that presents a perimetrical boundary of the movable structure that is greater than the closed position. The open position is often referred to as an object being "open."

Orientation: As used in this disclosure, orientation refers to the positioning of a first object relative to: 1) a second object; or, 2) a fixed position, location, or direction.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Piano Hinge: As used in this disclosure, a piano hinge is: 1) a hinge that is longer than 12 inches; and 2) has a pin that runs fully along at least one of the surfaces that the piano hinge is attached to. Piano hinges are also commonly referred to as continuous hinges.

Posterior: As used in this disclosure, posterior is a term that is used to refer to the side of an object that is distal or in the opposite direction of the anterior side. When comparing two items, the posterior item is the item that is distal from the anterior of the object.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Puzzle: As used in this disclosure, a puzzle is a recreational or learning activity wherein the goal of the recreational or learning activity that involves mental activity in order to resolve problem.

Rectangle: As used in this disclosure, a rectangle is an enclosed four sided geometric structure. Each angle formed by the rectangle is a right angle. A non-Euclidean rectangle is a rectangle that is formed on a non-Euclidean plane.

Rectangular Block: As used in this disclosure, a rectangular block refers to a three-dimensional prism structure comprising six rectangular surfaces (commonly called faces) formed at right angles. Within this disclosure, a rectangular block may further comprise rounded edges and corners.

Rotation: As used in this disclosure, rotation refers to the cyclic movement of an object around a fixed point or fixed axis. The verb of rotation is to rotate.

Segregated Space: As used in this disclosure, a segregated space refers to a first negative space that does not overlap with a second negative space. By overlap is meant that that the first negative space and a second negative space do not share any common spaces. As a practical matter, when two negative spaces are formed such that a fluid will not flow between the two negative spaces, the two negative spaces can be considered segregated. A segregated space that allows fluid to flow between the two negative spaces is often called a divided space.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Tabs and Slots: As used in this disclosure, the terms tabs and slots refer to structures formed in the lateral edges of a plurality of disk-shaped structures. The tabs and slots are used to interconnect the plurality of disk-shaped structures. A common example of the use of tabs and slots to interconnect a plurality of disk-shaped structures is a jigsaw puzzle. The tab refers to an irregularly shaped disk structure such that attaches to the lateral face of a second disk structure such that the tab and the disk structure combine to form irregular disk shape. The slot is a negative space that forms an irregularly shaped disk structure within a solid disk structure. When interconnecting the plurality of disk-shaped structures, the tab of a first disk-shaped structure selected from the plurality of disk-shaped structures is geometrically similar to the slot of a second disk-shaped structure selected from the plurality of disk-shaped structures such that the tab inserts into the slot to attach the first disk-shaped structure to the second disk-shaped structure. The attachment of a tab to a slot is often referred to as interlocking. Always use Prism series, negative space.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A support board for use with a puzzle or a game comprising an assembly structure and a plurality of piece pans;

wherein the plurality of piece pans mount in the assembly structure;

wherein the support board for use with a puzzle or a game: a) forms a raised horizontal surface; and b) forms a storage structure;

wherein the assembly structure comprises a plurality of assembly pans and a piano hinge;

wherein the piano hinge attaches to the plurality of assembly pans;

wherein the plurality of assembly pans comprises a first assembly pan and a second assembly pan;

wherein the first assembly pan comprises a first closed face, a first open face, a first plurality of lateral faces, and a first divider plate;

wherein the first open face is the face of the first assembly pan that is distal from the first closed face;

wherein the first plurality of lateral faces form the balance of the containment surfaces of the first assembly pan;

wherein the first divider plate forms the physical structure that divided the hollow interior of the first assembly pan into two segregated spaces.

2. The support board for use with a puzzle or a game according to claim 1 wherein the support board for use with a puzzle or a game is a collapsible structure.

3. The support board for use with a puzzle or a game according to claim 2 wherein the assembly structure rotates between a closed position and an open position;

wherein the assembly structure forms the raised horizontal surface in the open position;

wherein the assembly structure has a disk shape;

wherein the assembly structure is formed as a lateral disk structure;

wherein the assembly structure is a rotating structure;

wherein the assembly structure rotates between a closed position and an open position;

wherein the assembly structure forms a divided pan structure in the open position;

wherein by divided pan structure is meant that the assembly structure: a) has a pan shape when rotated into the open position; and, b) the hollow interior of the pan shape is divided into segregated spaces;

wherein the assembly structure forms the raised horizontal surface in the open position;

wherein the assembly structure forms a protected space when the assembly structure rotates into the closed position.

4. The support board for use with a puzzle or a game according to claim 3 wherein the plurality of piece pans comprises a collection of individual piece pans;

wherein each individual piece pan selected from the plurality of piece pans is identical;

wherein each individual piece pan selected from the plurality of piece pans has a disk shape;

wherein each selected individual piece pan has a pan shape;

wherein each selected individual piece pan maintains the subset of puzzle pieces in an accessible manner when the assembly structure is in the open position;

wherein each selected individual piece pan forms a protected space that contains the subset of puzzle pieces in an accessible manner when the assembly structure is in the closed position;

wherein the form factor of any initial individual piece pan selected from the plurality of piece pans is identical to any subsequent individual piece pan selected from the plurality of piece pans;

wherein each selected individual piece pan further comprises an individual pp open face and an individual pp closed face;

wherein the individual pp open face is the open face of the pan shape of the individual piece pan;

wherein the individual pp open face is the face of the individual piece pan that is placed flush against the interior surface of a face selected from the group consisting of: a) the first closed face of the first assembly pan; and, b) the second closed face of the second open face;

wherein the individual pp closed face is the closed face of the pan shape of the individual piece pan;

wherein the individual pp closed face is the face of the individual piece pan that is distal from the individual pp open face.

5. The support board for use with a puzzle or a game according to claim 4 wherein each assembly pan selected from the plurality of assembly pans has a disk shape;

wherein each selected assembly pan forms a divided pan structure;

wherein the piano hinge is a hinge structure;

wherein the piano hinge is a rotating structure;

wherein the piano hinge allows the assembly structure to rotate between the closed position and the open position.

6. The support board for use with a puzzle or a game according to claim 5 wherein the first assembly pan has a disk shape;

wherein the first assembly pan has a rectangular block structure;

wherein the first assembly pan has a pan shape;

wherein the second assembly pan has a disk shape;

wherein the second assembly pan has a rectangular block structure;

wherein the second assembly pan has a pan shape;

wherein the form factor of the second assembly pan is identical to the form factor of the first assembly pan;

wherein the piano hinge attaches to the second assembly pan to the first assembly pan such that the second assembly pan rotates relative to the first assembly pan;

wherein the second assembly pan rotates relative to the first assembly pan such that the assembly structure rotates between the closed position and the open position;

wherein the first assembly pan and the second assembly pan form the lateral disk structure of the assembly structure when the assembly structure rotates into the open position;

wherein the first assembly pan and the second assembly pan form the protected space formed by the assembly structure when the assembly structure rotates into the closed position.

7. The support board for use with a puzzle or a game according to claim 6 wherein the first assembly pan further includes a first perimeter cushion structure;

wherein the first closed face is the closed face of the pan shape of the first assembly pan;

wherein the first closed face forms the containment surface of the first assembly pan with the greatest surface area;

wherein the first open face is the open face of the pan shape of the first assembly pan;

wherein the first plurality of lateral faces form the lateral face structure of the pan shape of the first assembly pan;

wherein the first plurality of lateral faces comprises a first superior lateral face, a first inferior lateral face, a first exterior lateral face, and a first interior lateral face;

wherein the first superior lateral face is the lateral face of the first assembly pan with the greatest span of length;

wherein the first superior lateral face forms an exterior face of the lateral disk structure of the assembly structure when the assembly structure is in the open position;

wherein the first inferior lateral face is the lateral face of the first assembly pan that is distal from the first superior lateral face;

wherein the first inferior lateral face forms an exterior face of the lateral disk structure of the assembly structure when the assembly structure is in the open position;

wherein the first exterior lateral face is the remaining lateral face of the first assembly pan that forms an exterior face of the lateral disk structure of the assembly structure when the assembly structure is in the open position;

wherein the first interior lateral face is the lateral face of the first assembly pan that is distal from the first exterior lateral face;

wherein the first divider plate mounts on the interior surface of the first closed face such that the center axis of the first divider plate is parallel to the first superior lateral face and the first inferior lateral face;

wherein the first divider plate is located on the first closed face such that the center axis of the first divider plate is halfway between the first superior lateral face and the first inferior lateral face;

wherein the first perimeter cushion structure forms a cushion structure that protects a portion of the perimeter surface of the first open face;

wherein the first perimeter cushion structure is a felt padding that protects the inferior lip, the perimeter surface, and the exterior lip structures of the following lateral face structures: a) the first superior lateral face; b) the first inferior lateral face; and, c) the first exterior lateral face.

8. The support board for use with a puzzle or a game according to claim 7 wherein the second assembly pan comprises a second closed face, a second open face, a second plurality of lateral faces, a second divider plate, and a second perimeter cushion structure;

wherein the second closed face is the closed face of the pan shape of the second assembly pan;

wherein the second closed face forms the containment surface of the second assembly pan with the greatest surface area;

wherein the second open face is the open face of the pan shape of the second assembly pan;

wherein the second open face is the face of the second assembly pan that is distal from the second closed face;

wherein the second plurality of lateral faces form the lateral face structure of the pan shape of the second assembly pan;

wherein the second plurality of lateral faces form the balance of the containment surfaces of the second assembly pan;

wherein the second plurality of lateral faces comprises a second superior lateral face, a second inferior lateral face, a second exterior lateral face, and a second interior lateral face;

wherein the second superior lateral face is the lateral face of the second assembly pan with the greatest span of length;

wherein the second superior lateral face forms an exterior face of the lateral disk structure of the assembly structure when the assembly structure is in the open position;

wherein the second inferior lateral face is the lateral face of the second assembly pan that is distal from the second superior lateral face;

wherein the second inferior lateral face forms an exterior face of the lateral disk structure of the assembly structure when the assembly structure is in the open position;

wherein the second exterior lateral face is the remaining lateral face of the second assembly pan that forms an exterior face of the lateral disk structure of the assembly structure when the assembly structure is in the open position;

wherein the second interior lateral face is the lateral face of the second assembly pan that is distal from the second exterior lateral face;

wherein the second divider plate mounts on the interior surface of the second closed face such that the center axis of the second divider plate is parallel to the second superior lateral face and the second inferior lateral face;

wherein the second divider plate is located on the second closed face such that the center axis of the second divider plate is halfway between the second superior lateral face and the second inferior lateral face;

wherein the second divider plate forms the physical structure that divided the hollow interior of the second assembly pan into two segregated spaces;

wherein the second perimeter cushion structure forms a cushion structure that protects a portion of the perimeter surface of the second open face;

wherein the second perimeter cushion structure is a felt padding that protects the inferior lip, the perimeter surface, and the exterior lip structures of the following lateral face structures: a) the second superior lateral face; b) the second inferior lateral face; and, c) the second exterior lateral face.

9. The support board for use with a puzzle or a game according to claim 8 wherein the first open face and the second open face are aligned when the assembly structure rotates into the closed position;

wherein the first open face and the second open face are the faces of the lateral disk structure of the assembly structure that rest on a supporting surface when the assembly structure forms the raised horizontal surface in the open position;

wherein the piano hinge attaches the exterior lip of the first assembly pan to the second assembly pan by attaching the exterior lip of the first interior lateral face to the exterior lip of the second interior lateral face.

* * * * *